US005678708A

United States Patent [19]

Forsberg et al.

[11] Patent Number: 5,678,708

[45] Date of Patent: Oct. 21, 1997

[54] EXTENDIBLE CRANE BOOM

[75] Inventors: Lars Forsberg, Harmånger; Kenneth Ljungberg, Hudiksvall; Tommy Sjöström, Hudiksvall; Jens Stolpe, Hudiksvall, all of Sweden

[73] Assignee: HIAB AB, Hudiksvall, Sweden

[21] Appl. No.: 537,817

[22] PCT Filed: Apr. 15, 1994

[86] PCT No.: PCT/SE94/00334

§ 371 Date: Oct. 24, 1995

§ 102(e) Date: Oct. 24, 1995

[87] PCT Pub. No.: WO94/25387

PCT Pub. Date: Nov. 10, 1994

[30] Foreign Application Priority Data

Apr. 26, 1993 [SE] Sweden ..... 9301382

[51] Int. Cl.[6] ..... B66C 23/693

[52] U.S. Cl. ..... 212/349; 152/118; 212/230

[58] Field of Search ..... 212/349, 231, 212/230, 288, 289; 52/118

[56] References Cited

U.S. PATENT DOCUMENTS

| | | | |
|---|---|---|---|
| 3,445,004 | 5/1969 | Grider et al. | 212/349 |
| 3,721,054 | 3/1973 | Hornagold . | |
| 3,804,262 | 4/1974 | Wiencek et al. . | |
| 4,575,976 | 3/1986 | McDermott et al. | 212/349 |
| 5,501,346 | 3/1996 | Wimmer | 212/231 |

FOREIGN PATENT DOCUMENTS

| | | | |
|---|---|---|---|
| 2000112 | 8/1969 | France . | |
| 2103570 | 8/1972 | Germany . | |
| 309660 | 3/1969 | Sweden . | |
| 394102 | 6/1977 | Sweden . | |
| 461045 | 2/1975 | U.S.S.R. | 212/349 |
| 1356517 | 6/1974 | United Kingdom . | |

*Primary Examiner*—Thomas J. Brahan
*Attorney, Agent, or Firm*—Young & Thompson

[57] ABSTRACT

An extendible crane boom comprises, in addition to a tubular base boom section (1), a plurality of boom sections (2, 3, 4, 5) telescopically within the base boom section and each composed of a tube and a holder (8, 8', 8", 8''') mounted at an outer end thereof for connecting the tube to a double-acting hydraulic cylinder (9, 9', 9", 9''') with a view to displacing each boom section out of and into an immediately preceding boom section so as to lengthen and shorten, respectively, the crane boom in its entirety. The third and fourth hydraulic cylinders (9", 9''') are located in a first plane which is parallel to the longitudinal extent of the boom and located inwardly of a second plane, in which the first and second hydraulic cylinders (9, 9') are located. This minimizes the overall height of the outermost telescopic boom sections (4, 5), counted as the center distance between the telescopic tube concerned and the associated hydraulic cylinder.

12 Claims, 2 Drawing Sheets

EXTENDIBLE CRANE BOOM

TECHNICAL FIELD OF THE INVENTION

This invention relates to an extendible crane boom, e.g. an outer boom, of the type comprising, in addition to a tubular base boom section, at least three or four boom sections telescopically arranged within the base boom section and each composed of a tube and a holder mounted at an outer end of the tube for connecting it to a double-acting hydraulic cylinder which has a cylinder part and a piston rod, is located outside the associated tubular boom section and serves to displace each boom section out of and into an immediately preceding boom section so as to lengthen and shorten, respectively, the crane boom in its entirety.

BACKGROUND ART

In prior-art crane booms of %he above type, the hydraulic cylinders required for extending and shortening the boom are positioned so that the extension units, consisting of a boom section and an associated exterior hydraulic cylinder, will have an increasing overall height in the direction of the free end or tip of the crane boom. For example, in a crane having four extension units, the two cylinders of the first and the second boom section are disposed in a common plane which is parallel to the longitudinal extent of the boom and located comparatively close to the upper Side Of the base boom section, while the cylinders of the third and fourth boom sections are located in a common plane above or outside the two first-mentioned cylinders. In this manner, the overall height, counted as the centre distance between the individual boom section and the associated hydraulic cylinder, becomes greater at the outer two extension units than at the inner ones. This difference in overall height is further pronounced if, for lack of space, the first and second cylinders and the third and fourth cylinders, respectively, cannot be arranged side by side in common planes but must be arranged in the same vertical plane through the crane boom. In those cases, the difference in overall height becomes excessive. The fact that the different extension units will have an increasing overall height towards the boom tip entails a number of inconveniences in actual practice. Besides the crane boom having a structurally/aesthetically less attractive appearance when in the extended or maximally lengthened state, the fact that %he outermost extension unit has the largest overall height causes difficulties in operating the crane in certain situations. One example of such a situation is the case when a load suspended from the tip of the crane boom is to be passed through an opening of limited size, such at a window opening in a building. The large overall height of the outermost extension unit makes this unit difficult to maneuver through the opening. In addition, the crane boom will never be exactly straight when in the extended, loaded state, but will instead have a more or less pronounced bow shape (banana shape). When, therefore, a load at the tip of a crane boom introduced through such an opening is released from the tip, the bow-shaped crane boom will spring back towards a more rectilinear shape. There is then a manifest risk that the piston rod of the outermost, third or fourth cylinder will bump against the frame of the opening and be damaged. Another drawback resulting from the overall height of the different extension units increasing towards the crane tip is that the cylinder holders (or "noses") of the outer unit or units become large-sized, unwieldy and expensive.

OBJECTS AND FEATURES OF THE INVENTION

The present invention aims to overcome the above-mentioned drawbacks and provide an extendible crane boom which is easy to operate also in cramped spaces and which, additionally, has an aesthetically attractive appearance. According to the invention, this object it achieved by means of the features recited in the characterising clause of appended claim 1.

Other preferred features of the inventive crane boom will appear from the dependent claims.

BRIEF DESCRIPTION OF THE ACCOMPANYING DRAWINGS

In the drawings,

FIG. 1 is a partially cut and partially simplified perspective view of a crane boom according to the invention shown in an intermediate position between maximum and minimum crane boom length, and FIG. 2 schematically illustrates a duct system for feeding hydraulic oil between different hydraulic cylinders included in the crane boom.

DETAILED DESCRIPTION OF A PREFERRED EMBODIMENT OF THE INVENTION

Figure 1:
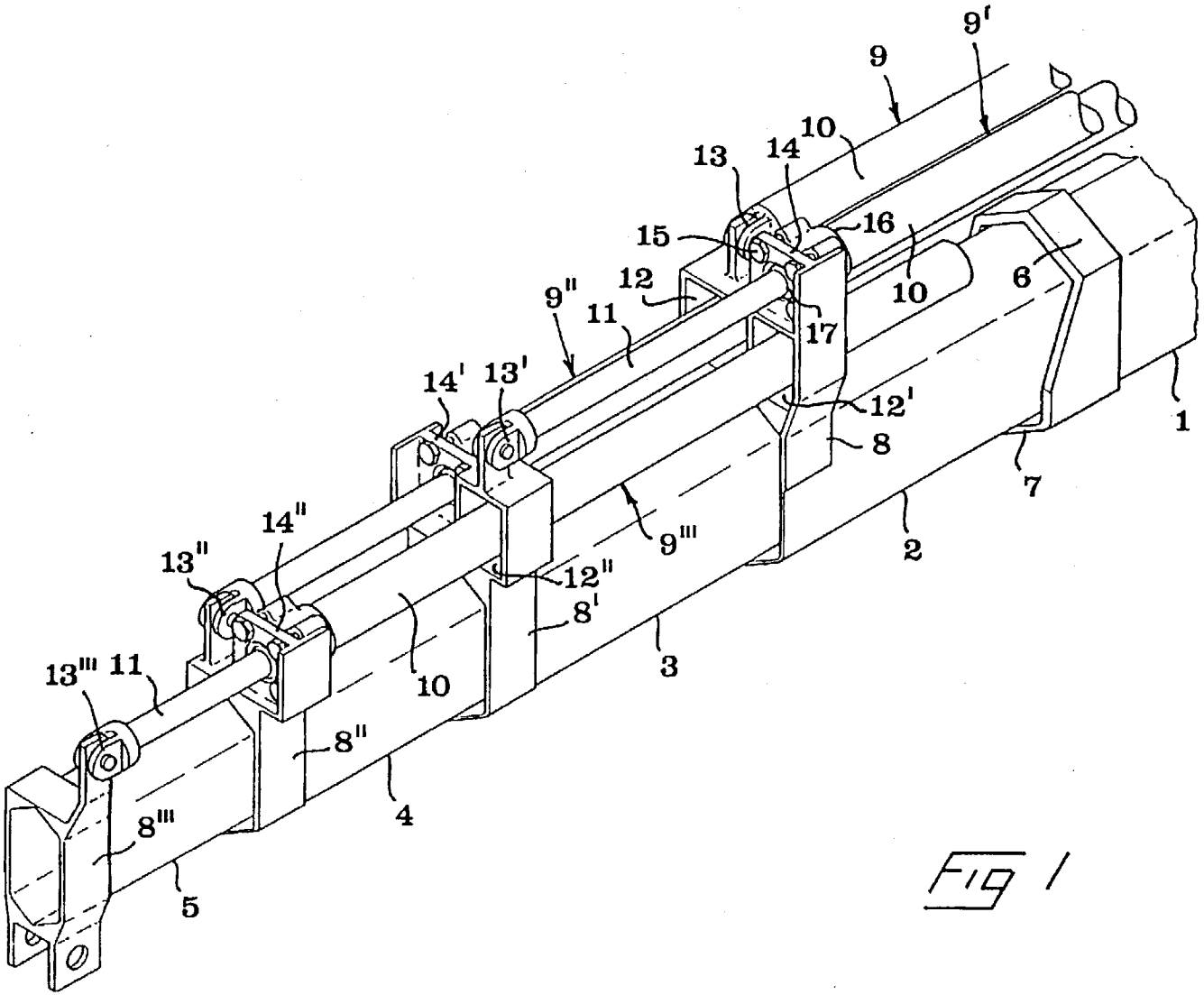

The crane boom shown in FIG. 1 comprises a base boom section, generally designated 1, and four boom sections 2, 3, 4 and 5 arranged telescopically therein. In practice, the illustrated crane boom may advantageously constitute the outer boom of a knuckle boom crane, the base boom section 1 being articulated at its rear end (not shown) to the first boom section of the crane. However, it should be emphasised that the concept of the invention is in no way restricted to outer booms. Thus, the inventive concept described below is applicable to any type of crane that requires an extendible crane boom, such as pin-boom-type cranes or the like. In FIG. 1, numeral 6 designates an upper side and 7 an underside of the crane boom. It should however be pointed out that the terms "upper side" and "underside" as used herein basically express a temporary state, e.g. when an outer boom is extending approximately horizontally from an associated first boom section. In other working positions, in which the crane boom is pivoted 90° or more from such a horizontal position, the upper side 6 is however turned downwards and the underside 7 upwards. With a view to facilitating the following description of the crane boom, it should also be pointed out that the base boom section 1 is in an inner or rear position relative to the free outer end or tip of the boom.

Not only the base boom section I but also each of the boom sections 2, 3, 4, 5 are in practice made of tubes or tube sections which in the illustrated example have a hexagonal cross-sectional shape, the boom sections having gradually decreasing cross-sectional dimensions, so that the tube 2 can be inserted in the tube 1, the tube 3 in the tube 2 and so forth. Each telescopic boom section or tube 2–5 is provided at its outer or free end with a holder 8, 8', 8", 8'" serving to connect the individual telescopic tube to an associated hydraulic cylinder, generally designated 9, 9', 9" and 9'", respectively. Each such hydraulic cylinder is double-acting in known manner and incorporates a cylinder part 10 and a piston rod 11, which is movable out of and into the associated cylinder part. It should be noted in particular that the hydraulic cylinders 9', 9" and 9'" of the three outermost telescopic tubes 3, 4, 5 are so oriented that the piston rods 11 point towards the tip of the crane boom, while the hydraulic cylinder 9 of the telescopic tube 2 is turned in the opposite direction, i.e. has its cylinder part 10 connected to the holder 8, while the piston rod is directed towards the inner end of the crane boom and is connected (in a manner not shown) to the base boom section 1.

According to the inventive principle, the hydraulic cylinders 9" and 9"' of the outer two telescopic tubes 4 and 5 are arranged in a first plane which is located inwardly of or below a second plane, in which the two hydraulic cylinders 9, 9' of the telescopic tubes 2 and 3 are located, as clearly seen in FIG. 1. In this way, the overall height of the two outermost boom sections; that is, the center to center distance between (a) the individual telescopic tube 4,5 and (b) the associated hydraulic cylinder 9" and 9"', respectively, is minimized. To enable this location of the outer two hydraulic cylinders under the two inner ones, the holder 8 of the first telescopic tube 2 is in this case provided with two passages 12, 12', through which the cylinder parts 10 of the two hydraulic cylinders 9", 9"' can pass freely forwards or rearwards. Moreover, the holder 8 includes an articulation or hinge connection 13 which connects the first hydraulic cylinder 9 to the holder 8 in such a manner that the cylinder can be pivoted at least slightly in relation to the holder. This pivotal movability is necessary to permit taking up irregularities which in practical use occur in the translatory displacement of the telescopic tube 2 relative to the base boom section 1. The holder 8 further includes an attachment, generally designated 14, for the cylinder part 10 of the hydraulic cylinder 9'. In practice, this attachment advantageously is in the form of a plate rigidly connected to the holder and formed with a plurality (e.g. four) of holes for receiving screws 15, by means of which the cylinder part 10 is connected to the plate 14 via a coupling 16 which enables adjustment of the axial position of the cylinder part 10. By means of this coupling, which is described in more detail in Applicant's Swedish Patent Application 9301338-1, the cylinder can be quickly and easily set in an axial position which is exactly parallel to the longitudinal axis of the base boom section 1, without necessitating any excessive tolerance requirements to be placed on the fixing plate 14 or the holder. It should also be noted that the fixing plate 14 has a central hole 17, through which the piston rod 11 of the hydraulic cylinder 9' can pass freely.

Similarly, the second holder 8' has a passage 12" for the cylinder part 10 of the hydraulic cylinder 9"' , an attachment 14' for the cylinder part of the hydraulic cylinder 9", as well as an articulation 13' connecting the free end of the piston rod of the hydraulic cylinder 9' to the holder 8'. The articulation 13' is located in a plane outside the plane in which the passage 12" and the attachment 14' are both located.

The third holder 8" has no cylinder passages of the above-mentioned type, but includes an attachment 14" and an articulation 13" connecting the piston rod of the hydraulic cylinder 9" to the holder 8".

Finally, the fourth holder 8"' includes but one articulation 13"' which connects the piston rod of the hydraulic cylinder 9"' to the free end of the outer telescopic tube 5. Moreover, the outer holder 8"' may either itself form a tool carrier or be connected to a tool carrier of any suitable type.

In the construction shown in FIG. 1, the outer two hydraulic cylinders 9", 9"' are movable back and forth in a plane located between the upper side of the crane boom or the base boom section i and the inner two hydraulic cylinders 9, 9'. Moreover, like the pair of inner cylinders 9, 9', the pair of outer cylinders 9", 9"' are advantageously located in a common plane which, as also seen in the lateral direction, is substantially parallel to the transverse plane of the crane boom, i.e. the longitudinal or centre axes of the cylinders 9", 9"' (and of the cylinders 9, 9') are located at the same distance from the centre axis or the transverse plane of the crane boom. Moreover, the two cylinders of both the outer pair 9", 9"' and of the inner pair 9, 9' are located substantially within the crane boom width which is determined by the distance between the two opposite long side surfaces of the base boom section 1. In other words, parts of the cylinders will not project laterally from the long side surfaces of the base boom section 1 when the crane boom is shortened to minimum length.

Figure 2:
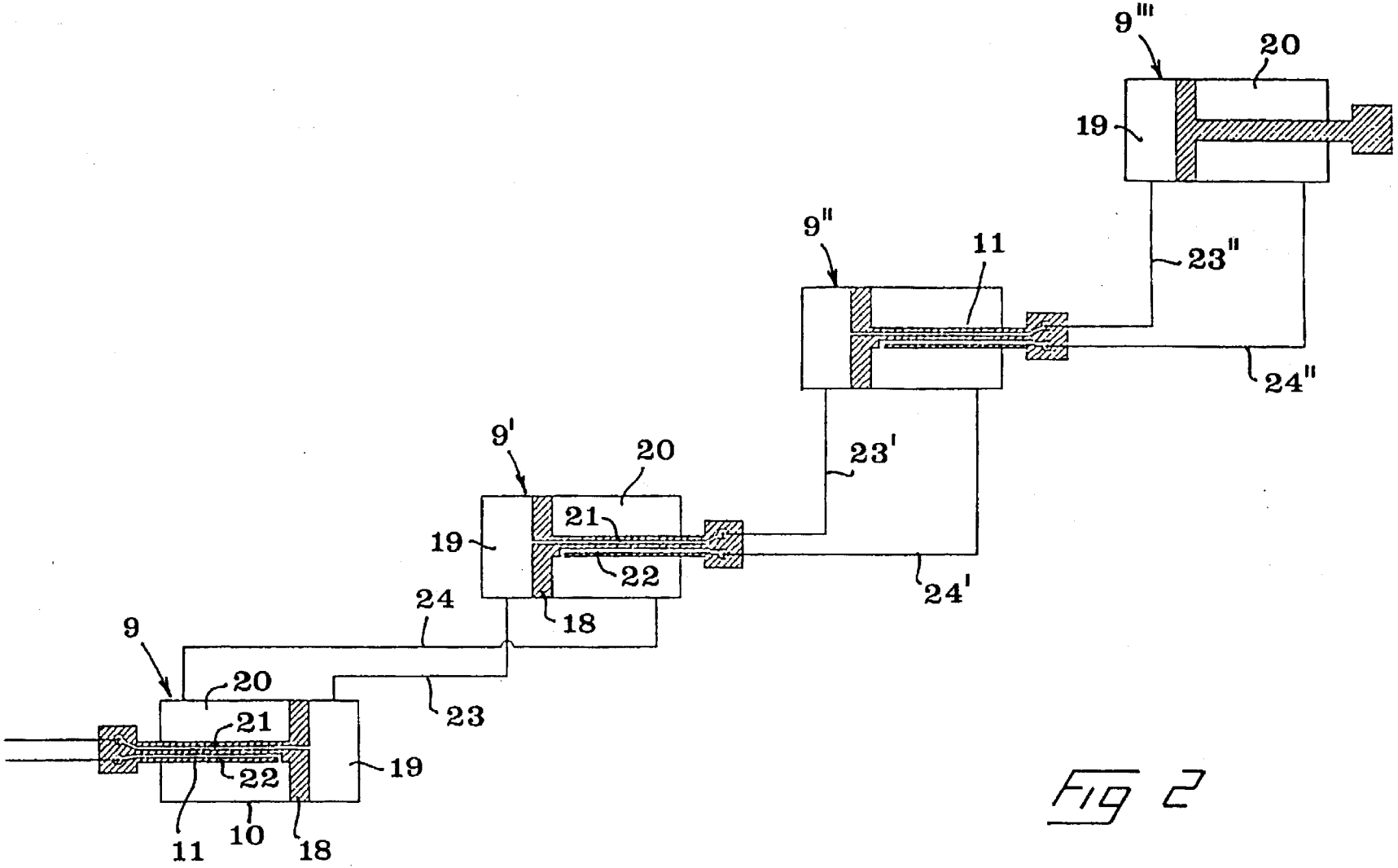

Reference is now made to FIG. 2 illustrating how the cylinder part 10 of each of the hydraulic cylinders 9, 9', 9" and 9"' contains a piston 18 connected to the associated piston rod 11 and dividing the interior of the cylinder part into a positive chamber 19 and a negative chamber 20. It should be observed that the piston rod 11 of the first, inner hydraulic cylinder 9, as intimated above, is facing in the Opposite direction from the associated piston as compared with the piston rods of the other hydraulic cylinders 9', 9" and 9"'. According to a special feature of the invention, the piston rods 11 of all the hydraulic cylinders, save the outermost, here the fourth cylinder 9"', are provided with two hydraulic oil ducts 21, 22, of which a first 21 communicates with the positive chamber 19 of the associated cylinder part 10 while the other 22 communicates with the negative chamber 20 of the same cylinder. Further, the cylinders are connected to each other via external, first and second intermediate ducts 23 and 24, respectively. More specifically, the intermediate duct 23 connects the positive chamber 19 of the cylinder 9 to the positive chamber of the cylinder 9'. The intermediate duct 23' connects the positive chamber of the cylinder 9" to the first duct 21 provided in the piston rod of the cylinder 9' and communicating with the positive chamber of the cylinder 9'. Similarly, the intermediate duct 23" connects the positive chamber of the hydraulic cylinder 9"' to the first piston-rod duct 21 in the cylinder 9" which communicates with the positive chamber of this cylinder. Thus, the intermediate ducts 23, 23' and 23" thus form, together with the first piston-rod ducts 21, a first duct system which connects the positive chambers of all the cylinders to each other. Analogously, the intermediate ducts 24, 24' and 24" form, together with the piston-rod duct 22, a second duct system which connects the negative chambers of all the cylinders to each other. It will be appreciated that when hydraulic oil is fed into the positive chambers of the cylinders (by feeding oil to the duct 21 in the piston rod of the inner hydraulic cylinder 9) while simultaneously evacuating a corresponding amount of oil from the negative chambers of the cylinders, the cylinders will be extended concurrently with an extension of the entire crane boom shown in FIG. 1. Conversely, the crane boom will be shortened if hydraulic oil is fed to the negative chambers of the cylinders by feeding hydraulic oil to the second duct 22 in the piston rod of the first hydraulic cylinder 9 while simultaneously evacuating oil from the positive chambers through the first duct system.

An essential advantage gained by arranging the first hydraulic cylinder 9 with the piston rod facing inwards is that it becomes easier to mount the conduits, in that the cylinder parts 10 of the two cylinders 9 and 9' will not be displaced relative to each other when the crane boom is extended and shortened. A highly contributory factor in this respect also is the provision of the ducts 21, 22 inside the piston rods of the cylinders 9' and 9", whereby the intermediate ducts used can be designed as short, fixed conduits, which need not be flexible hoses.

The advantages of the invention are obvious. By arranging the hydraulic cylinders of the outermost telescopic tube or tubes in one plane below or inwardly of the cylinders of the inner two telescopic tubes, the outer extension units will in all have a minimum overall height, i.e. the distance between each pair of cooperating telescopic tube and hydraulic cylinder in the two outermost extension units is minimized. This gives not only an attractive appearance to the crane, especially when maximally extended, but also a significantly improved maneuvering performance when introducing the crane tip into cramped spaces. Another essential advantage is the reduction of the size and, hence, of the weight of the required holders 8 ("noses").

CONCEIVABLE MODIFICATIONS OF THE INVENTION

It is understood that the invention is not restricted only to the embodiment described above and illustrated in the drawings. Although the invention has been exemplified with respect to a crane boom comprising, in addition to precisely four telescopic tubes or extension units, the base boom section proper, the invention is applicable also to such crane booms as incorporate a larger number or only three telescopic tubes. In the latter case, the two outermost hydraulic cylinders are suitably arranged in a common plane inwardly of or below the inner hydraulic cylinder (by comparison with FIG. 1, the inner telescopic tube 2 may then be regarded as replacing the base boom section 1, and one of the inner two hydraulic cylinders is dispensed which), In particularly narrow crane booms, it is also conceivable within the scope of the invention to arrange all the hydraulic cylinders in a common vertical plane instead of arranging them pairwise beside each other, as exemplified in FIG. 1.

We claim:

1. An extendible crane boom, comprising a tubular base boom section, at least three extension boom sections structured and arranged to telescopically extend into the base boom section, said at least three extension boom sections including a first extension boom section, a second extension boom section and a third extension boom section, and at least three double-acting hydraulic cylinders including a first cylinder comprising a first cylinder part and a first piston rod, a second cylinder comprising a second cylinder part and a second piston rod, and a third cylinder comprising a third cylinder part and a third piston rod, said at least three double-acting hydraulic cylinders being located outside of said at least three extension boom sections and said tubular base boom section and structured and arranged to displace a respective extension boom section out of and into an immediately preceding boom section so as to lengthen and shorten, respectively, the crane boom in its entirety, said first extension boom section comprising a first tube and a first holder mounted to an outer end of said first tube and to one of said at least three double-acting hydraulic cylinders, said second extension boom section comprising a second tube and a second holder mounted to an outer end of said second tube and to another of said at least three double-acting hydraulic cylinders, and said third extension boom section comprising a third tube and a third tube holder mounted to an outer end of said third tube and to yet another of said at least three double-acting hydraulic cylinders, said third cylinder being located in a first plane which is substantially parallel to a longitudinal axis of the telescopically arranged extension boom sections and base boom section, and located between (a) a second plane in which at least one of said first cylinder and said second cylinder is located and (b) said longitudinal axis.

2. A crane boom as claimed in claim 1, wherein said first extension boom section is the closest extension boom section to said base boom section, and further wherein said first holder comprises (a) an articulation member which connects said first holder to said first cylinder so that said first cylinder is pivotable about a pivotal axis relative to said first holder, said pivotal axis extending in said second plane; (b) an attachment member attaching the second cylinder part to said first holder, said second piston rod being movable back and forth through said attachment member in the direction of an attachment axis; and (c) a first passage having a first passage axis through which said third cylinder part is freely movable back and forth, said first passage axis extending in said first plane.

3. A crane boom as claimed in claim 2, wherein said at least three double-acting hydraulic cylinders includes a fourth cylinder which comprises a fourth cylinder part and a fourth piston rod, and further wherein said at least three extension boom sections includes a further extension boom section comprising a fourth tube and a fourth tube holder mounted to an outer end of said fourth tube and to said fourth cylinder, said first holder comprising a second passage through which said fourth cylinder part is freely movable back and fourth, said second passage having a second passage axis which lies in said first plane, and said attachment axis extending in said second plane.

4. A crane boom as claimed in claim 3, wherein the first cylinder part is connected to the first holder, the first piston rod is connected to the base boom section, a distal end of the first piston rod extending from the first cylinder part towards the base boom section, and respective distal ends of the second piston rod and third piston rod are connected to said second holder and said third holder and extend from a respective second cylinder part and third cylinder part, away from said base boom section.

5. A crane boom as claimed in claim 2, wherein the first cylinder part is connected to the first holder, the first piston rod is connected to the base boom section, a distal end of the first piston rod extending from the first cylinder part towards the base boom section, and respective distal ends of the second piston rod and third piston rod are connected to said second holder and said third holder and extend from a respective second cylinder part and third cylinder part, away from said base boom section.

6. A crane boom as claimed in claim 2, wherein the piston rod of each cylinder, with the exception of the outermost cylinder, has formed therein two hydraulic oil ducts of which a first duct communicates with a positive chamber in a respective cylinder part and a second duct communicates with a negative chamber in a respective cylinder part, and that first intermediate ducts for hydraulic oil connect together the positive chambers and second intermediate ducts for hydraulic oil connect together the negative chambers.

7. A crane boom as claimed in claim 3, wherein the piston rod of each cylinder, with the exception of the outermost cylinder, has formed therein two hydraulic oil ducts of which a first duct communicates with a positive chamber in a respective cylinder part and a second duct communicates with a negative chamber in a respective cylinder part, and that first intermediate ducts for hydraulic oil connect together the positive chambers and second intermediate ducts for hydraulic oil connect together the negative chambers.

8. A crane boom as claimed in claim 1, wherein the first cylinder part is connected to the first holder, the first piston rod is connected to the base boom section, a distal end of the first piston rod extending from the first cylinder part towards the base boom section, and respective distal ends of the second piston rod and third piston rod are connected to said second holder and said third holder and extend from a respective second cylinder part and third cylinder part, away from said base boom section.

9. A crane boom as claimed in claim 8, wherein the piston rod of each cylinder, with the exception of the outermost cylinder has formed therein two hydraulic oil ducts of which a first duct communicates with a positive chamber in a respective cylinder part and a second duct communicates with a negative chamber in a respective cylinder part, and that first intermediate ducts for hydraulic oil connect together the positive chambers and second intermediate ducts for hydraulic oil connect together the negative chambers.

10. A crane boom as claimed in claim 1, wherein the piston rod of each cylinder, with the exception of the outermost cylinder, has formed therein two hydraulic oil ducts of which a first duct communicates with a positive chamber in a respective cylinder part and a second duct communicates with a negative chamber in a respective cylinder part, and that first intermediate ducts for hydraulic oil connect together the positive chambers and second intermediate ducts for hydraulic oil connect together the negative chambers.

11. An extendable crane boom, comprising:

a tubular base boom section;

a plurality of tubular extension boom sections which are telescopic in relation to each other and in relation to said base boom section, said plurality of tubular extension boom sections including at least a first extension boom section, a second extension boom section and a third extension boom section, said first extension boom section structured and arranged to be movable out of and into said base boom section in the direction of a longitudinal axis of said base boom section, said longitudinal axis extending in a first plane, said second extension boom section structured and arranged to be movable out of and into said first extension boom section in the direction of said longitudinal axis, and said third extension boom section structured and arranged to be movable out of and into said second extension boom section in the direction of said longitudinal axis, to lengthen and shorten, respectively, said extendable crane boom;

a plurality of double-acting hydraulic cylinders positioned outside of said base boom section and said first extension boom section, said second extension boom section and said third extension boom section, said plurality of double-acting hydraulic cylinders comprising at least a first cylinder, a second cylinder and a third cylinder, said first cylinder having a first cylinder axis and comprising a first cylinder part and a ,first piston rod, said second cylinder having a second cylinder axis and comprising a second cylinder part and a second piston rod, and said third cylinder having a third cylinder axis and comprising a third cylinder part and a third piston rod, said first cylinder axis being parallel to said longitudinal axis and extending in a second plane which is parallel to said first plane, said second cylinder axis and said third cylinder axis each extending in a third plane which is parallel to said first plane and said second plane, said second cylinder axis being parallel to said third cylinder axis, said first cylinder axis and said longitudinal axis, one of said second plane and said third plane being positioned between (a) the other of said second plane and said third plane and (b) said first plane;

means for connecting one of said first extension boom section, said second extension boom section and said third extension boom section to said first cylinder;

means for connecting another of said first extension boom section, said second extension boom section and said third extension boom section to said second cylinder;

means for connecting yet another of said first extension boom section, said second extension boom section and said third extension boom section to said third cylinder; and means for lengthening and shortening said extendable crane boom by moving said first extension boom section, said second extension boom section and said third extension boom section out of and into said base boom section, said first extension boom section and said second extension boom section, respectively, by actuating said first cylinder, said second cylinder and said third cylinder.

12. The extendable crane boom of claim 11 wherein said third plane is positioned between said second plane and said first plane.

* * * * *